US005557388A

United States Patent [19]

Creutzmann et al.

[11] Patent Number: 5,557,388

[45] Date of Patent: Sep. 17, 1996

[54] PRINTING OR COPYING MACHINE HAVING A COOLING DEVICE FOR THE RECORDING SUBSTRATE

[75] Inventors: Edmund Creutzmann, Markt Schwaben; Joachim Hoffmann, München; Walter Kopp, Taufkirchen, all of Germany

[73] Assignee: Siemens Nixdorf Informationssysteme Aktiengesellschaft, Paderborn, Germany

[21] Appl. No.: 428,118

[22] PCT Filed: Oct. 13, 1993

[86] PCT No.: PCT/DE93/00976

§ 371 Date: Apr. 20, 1995

§ 102(e) Date: Apr. 20, 1995

[87] PCT Pub. No.: WO94/09409

PCT Pub. Date: Apr. 28, 1994

[30] Foreign Application Priority Data

Oct. 22, 1992 [DE] Germany ..... 42 35 667.9

[51] Int. Cl.[6] ..... G03G 21/00

[52] U.S. Cl. ..... 355/312; 355/282

[58] Field of Search ..... 355/282, 312, 355/322; 219/388

[56] References Cited

U.S. PATENT DOCUMENTS

| | | | |
|---|---|---|---|
| 3,502,407 | 7/1967 | Granzow et al. | 355/312 |
| 3,827,855 | 8/1974 | Blake . | |
| 4,460,350 | 7/1984 | Mittal et al. | 493/412 |
| 5,008,716 | 4/1991 | Onose et al. | 355/322 |

FOREIGN PATENT DOCUMENTS

| | | |
|---|---|---|
| 1937039 | 1/1970 | Germany . |
| 3934770 | 4/1991 | Germany . |
| WO91/09352 | 6/1991 | WIPO . |

OTHER PUBLICATIONS

*Patent Abstracts of Japan,* vol. 3, No. 96, "Fixing Apparatus for Zerographic Recording Member", Aug. 15, 1979.

*Research Disclosure,* No. 327, "Sheet Turnover and Cooling Device", Jul. 1991.

*Patent Abstracts of Japan,* vol. 15, No. 424, "Image Forming Device", Oct. 28, 1991.

*Primary Examiner*—Joan H. Pendegrass
*Assistant Examiner*—Quana Grainger
*Attorney, Agent, or Firm*—Hill, Steadman & Simpson

[57] ABSTRACT

A printing or copying apparatus is provided having a thermofixing device for fixing a toner image to a sheet recording medium or substrate, such as paper. The apparatus has at least one cooling device operable to cool the substrate after it passes through the thermofixing device and before the substrate is stacked. The cooling performed by the cooling device prevents the toner image from undesirably sticking to an adjacently overlying substrate surface after stacking.

13 Claims, 2 Drawing Sheets

PRINTING OR COPYING MACHINE HAVING A COOLING DEVICE FOR THE RECORDING SUBSTRATE

BACKGROUND OF THE INVENTION

The present invention generally relates to copiers or printers. More particularly, the present invention relates to such devices using a thermally applied toner image system.

In printing or copying machines which operate according to the transfer printing principle, be it according to the principle of electrophotography, ionography or magnetography, a toner image is produced on a recording substrate comprising single sheets or endless paper, using a printing device, and this toner image is then thermally fixed in a thermofixing station.

An electrophotographic printing device of this type for endless paper, having a thermal print fixing station, is known from WO 91/09352.

In printing or copying machines of this type, the recording substrate and the toner image fixed upon it, after leaving the fixing station, have a temperature in the range from 90° to 120° or higher, depending on the material property of the recording substrate, which generally comprises paper. In this temperature range, the toner is still in a tacky state. In the case of endless paper printers, the paper web, after it has left the fixing station, runs directly into a post-processing system or it is subsequently directly stacked up in a stacking device.

Now, during stacking it occurs that the printed image sides with their toner images lie on one another and thus also the one toner image of the one side lies on the toner image of the other side. If the temperature of the paper and hence of the toner image is still more than 60° after stacking, adhesion of the printed images lying on one another can occur.

When separating the sheets lying on one another (adhering toner images), disturbing print damage then occurs.

In order to avoid this adhering of the toner images, it is known from DE-A1 39 34 770 to arrange a blower in the region of the stacking device of an electrophotographic printing device, which blower, via an air stream which runs perpendicular to the paper transport direction, flows through the stack and cools the lather.

Furthermore, from JP-A-3-174570 (Patent Abstract of Japan P-1268, 28.10.91, Vol. 15, No. 424), an image-producing device is known, having a thermal print fixing station composed of a fixing roller and a nip roller. Arranged downstream of the fixing station is a thermal converter device with an associated electrical generator, which has a thermal transmission surface with a vaporizer. The residual heat of the transfer medium is removed via the thermal transmission surface and warms a heating medium in the vaporizer, the heating medium flowing through a turbine which drives a generator. The thermal converter or generator serves for the purpose of charging up a storage battery, in order in this manner to save the energy necessary for driving the image-producing device.

In JP-A-54-74444 (Patent Abstract of Japan E-130, 15.08.79, Vol. 3, No. 96), a description is given of a thermal fixing station for an electrophotographic copying machine, which has a heating plate over which the recording substrate is guided and which serves for the purpose of melting the toner on the recording substrate. In order that the heating plate comes into close contact with the recording substrate, a blower is arranged opposite the heating plate, the said blower pressing the recording substrate against the heating plate via an air stream.

In the case of rapid data printers operating in accordance with the principle of electrophotography, which operate in the uppermost printing speed range with a paper transport speed of up to 1 m per second and more, it is becoming more and more problematic to cool the paper, in the short interval between leaving the fixing station and stacking, to a temperature of 60°, that is to say the paper web must be cooled by about 60° Kelvin in about 0.5 second. This means a power dissipation of about 4000 W in 0.5 second. Since the thermal transfer between air add paper is only very poor, a correspondingly high air volume must be brought into contact with the paper surface in the short time and must also be specifically guided away again. This correspondingly requires blowers of high air volume with high noise development and large installation size. In addition, the air velocity must be correspondingly high, in order to bring a reasonably large part of the air volume into contact with the paper surface. This can lead to fluttering movements of the recording substrate, which have a disturbing effect during the stacking process.

It is an object of the invention to provide a printing or copying machine having a thermofixing arrangement, in which the recording substrate, after leaving the fixing device, is carefully and effectively cooled with low noise.

SUMMARY OF THE INVENTION

By means of the use of a cooling surface cooled by air, over which cooling surface the recording substrate is guided, an effective cooling of the recording substrate is possible without the previously described disadvantages occurring.

Provided as the cooling surface is a metal saddle, which has uniformly distributed openings, through which cool air is blown. The recording substrate is slightly lifted from the saddle by the emerging air in a gap of 0.1 to 0.5 mm. The air moves at high velocity in the narrow gap and as a consequence can be optimally heated by the hot paper web. Therefore, a smaller air volume with a smaller flow velocity is necessary than in the case of directly blowing onto the recording substrate web. In the case of directly blowing onto the recording substrate web, only a small fraction of the air volume is brought into contact with the hot paper surface, and that only for a very short time.

Since the given cooling path in the case of today's compact constructions of printers turns out to be only very small, the cooling time, due to the very high paper speed, is extremely small (100 msec to 200 msec). Therefore, in a further embodiment of the invention, it can be correspondingly favorable to provide additional cooling devices apart from the actual cooling device with one cooling surface. Said additional cooling devices can comprise a blower, with which the recording substrate is blown in the direction opposite to its running direction.

A further favorable location for arranging an additional cooling device of this type is the inlet region for a stacking device. Here it is possible to blow onto the recording substrate on both sides. It is expedient to direct the air stream onto the surface of the recording substrate in the direction opposite to its running direction. The surface boundary layer of air on the recording substrate is thereby penetrated by cooling air.

The cooling device is particularly suitable for use in a printing or copying machine with a thermal print fixing device having a preheating low temperature saddle located upstream in the running direction of the recording substrate. The low temperature saddle in this arrangement has a radius of curvature which ensures that the recording substrate is pressed against the saddle surface over the entire length of the preheating saddle. In a favorable manner, the cooling device, arranged downstream of the print fixing device composed of fixing roller and nip roller, has with respect to its cooling surface a similar radius of curvature to the preheating saddle. In this way the recording substrate rests flat on the cooling surface. The recording substrate runs through the fixing station having the preheating saddle and cooling device in a continuous undisturbed curve of constant radius. The recording substrate, preferably comprising paper, is thereby stressed as little as possible.

The objects are achieved, in an embodiment, by providing a printing or copying apparatus having a device for producing a toner image on a recording substrate or medium, such as paper. The apparatus includes a thermofixing device for fixing the toner image on the recording substrate with heat. The apparatus also includes a first cooling device for cooling the heated recording substrate arranged in a paper run region downstream of the thermofixing device in a direction of transport of the recording substrate. The cooling device has at least one cooling surface over which the recording substrate is guided. The cooling surface has a multiplicity of air exit openings and an air supply device [(31)] coupled to the air exit openings for producing an air stream in such a way that an air cushion is formed between the recording substrate and the cooling surface.

In an embodiment, the apparatus includes a transporter for moving the sheet or substrate relative to the thermofixing device along a transport direction. In an embodiment wherein the thermofixing device has a heat roller, the heat roller can also serve as the transporter.

In an embodiment, at least one additional or second cooling device is arranged in the paper run region on a side of the recording substrate opposite from the first cooling device. The second cooling device produces at least one second air stream sweeping over the recording substrate.

In an embodiment, the apparatus includes a stacking device for the recording substrate arranged downstream of the cooling device relative to the direction of transport of the recording substrate. An air stream device is provided at a recording substrate entry region of the stacking device. The air stream device for produces an air stream sweeping over at least one side of the recording substrate.

In an embodiment, at least one of the air streams sweeps over the recording substrate in a direction generally opposite to the direction of transport.

In an embodiment, the cooling surface has a surface geometry or contour which is consistent or contiguous with a passage path or direction of the recording substrate through the thermofixing device.

In an embodiment, preheating saddle (a low-temperature saddle) having a heating surface is positioned upstream of the thermofixing device relative to the running direction of the recording substrate. In a related embodiment, the cooling surface has a radius of curvature approximately corresponding to a radius of curvature of the preheating saddle.

Additional features and advantages are described in, and will be apparent from, the detailed description of the presently preferred embodiments and from the drawings.

DETAILED DESCRIPTION OF THE PRESENTLY PREFERRED EMBODIMENTS

Figure 1:
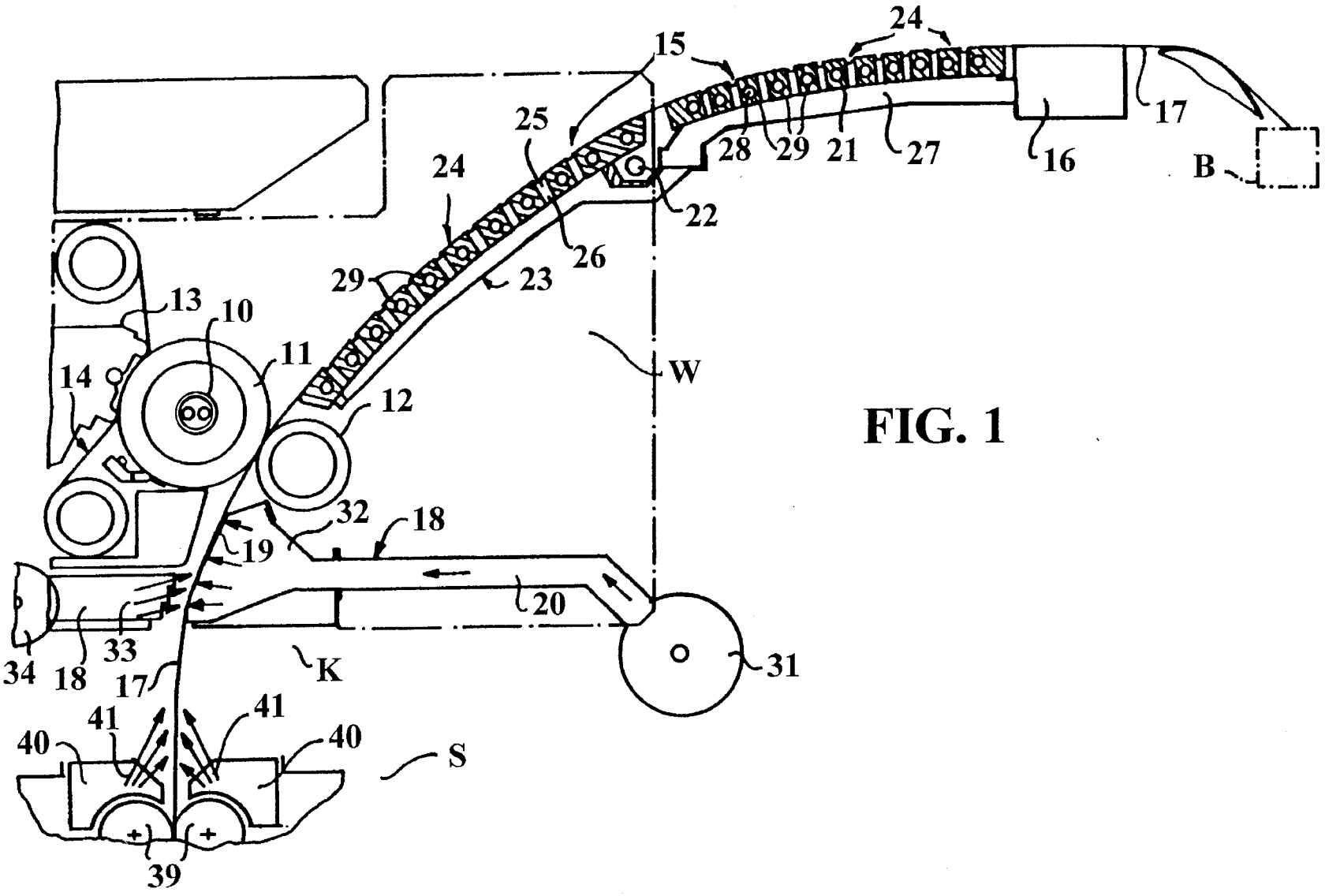
FIG. 1 shows a schematic sectional representation of the paper run of an image producing device as far as a stacking device in an electrophotographic printing machine.

An electrophotographic printing device, not shown here in detail, for operation with endless paper contains an image-producing device B for producing a toner image on the endless paper, which can, for example, be designed corresponding to WO 91/09352, as well as a thermal fixing device W with a recording substrate cooling device K arranged downstream and a stacking device S stacking the printed recording substrate.

The thermal fixing device W is designed as a thermal print fixing device. It contains a heating roller 11, heated via radiators 10, and a nip roller 12 which can be pivoted to and from the heating roller 11 by an electric motor. The heating or fixing roller 11 comprises an aluminum cylinder with a heat-proof coating arranged on the latter, the nip roller 12 comprises an aluminum cylinder with a coating of silicone. The heating or fixing roller 11 is driven by an electric motor. An oiling device 13 for applying separating oil to the heating roller via an oil applicator 14 is allocated to said heating or fixing roller 11. Positioned upstream of the rollers 11 and 12 in the direction of transport of the recording substrate is a heated preheating saddle 15 with associated vacuum brake 16, which saddle serves for the purpose of preheating a recording substrate 17 designed as endless paper and of feeding it in the preheated condition to the actual fixing gap between the rollers 11 and 12. Braked by the vacuum brake 16 and driven via the rollers 11 and 12, the recording substrate 17 is guided tautly over the preheating saddle 15. An unfixed toner image located on the recording substrate is thereby preheated on the preheating saddle 15 and fixed by means of pressure and heat between the rollers 11 and 12.

A cooling device K arranged downstream of the rollers 11 and 12 in the running direction of the recording substrate ensures cooling of the heated recording substrate 17. For this, the cooling device in the case of the embodiment shown has a cooling surface 19 provided with openings, which is swept by the recording substrate 17, cold air supplied via an air supply channel 20 flowing out of the openings and a cooling air cushion being produced under the recording substrate. Simultaneously, via an opposite profile 18, air is blown onto the toner-laden side of the recording substrate, specifically in a direction opposite to the running direction of the recording substrate.

In the case of the thermal fixing device described, the preheating of the endless paper 17 is carried out via a preheating saddle 15, which comprises two heated saddles connected one after the other, namely a fixed preheating saddle 21 and a heating saddle 23 which can be pivoted around a point of rotation 22. Preheating saddle 21 and heating saddle 23 form two separate heating zones, seen in the paper running direction. The entire preheating path in this arrangement has a length of approximately 500 to 700 mm. The recording substrate 17, during preheating, glides with its toner-free side on gliding surfaces 24 of the preheating saddle 21 and the heating saddle 23.

In order to produce good contact between the saddles and the recording substrate, and thus to keep temperature differences small, the gliding surfaces and the saddles have a radius of curvature which is approximately 700 mm in the case of the example shown. By means of the curvature of the gliding surfaces 24, in conjunction with the pull via the rollers 11 and 12 and the braking by the vacuum brake 16, a force component, which presses the recording substrate 17 onto the gliding surfaces 24, acts over the entire saddle length. In addition, the saddles 21 and 23 have extended recesses 25 transversely to the running direction of the recording substrate and extending over the entire width of the saddles. The recesses are connected to a vacuum channel 27 via lateral bores 26. The vacuum channel runs underneath the saddles 21 and 23 and is connected to a vacuum-producing device, for example a pump. By means of the vacuum, the recording substrate 17 (paper) is sucked onto the gliding surfaces 24 of the saddles and the water vapor being freed by means of the preheating is sucked away.

The heating of the saddles 21 and 23 is carried out by means of electrical resistance elements in the form of exchangeably arranged heating cartridges 28. The saddles have continuous bores 29 for holding the heating cartridges 28.

In order to keep the thermal loading for the recording substrate 17 as small as possible, the preheating saddle comprising preheating saddle and heating saddle 23 is designed as a low temperature saddle with the largest possible constructional length, so that the temperature difference between recording substrate 17 and saddle 15 becomes as small as possible. By means of the large constructional length in conjunction with a control of the heating power of the electrical resistance elements via a control arrangement, there results along the saddle an approximately constant energy flow from the saddle 15 onto the recording substrate 17.

The temperature supply in the fixing gap between the rollers 11 and 12 is of importance. In this case, the recording substrate must likewise be heated up in the region of this fixing gap in such a way that no high thermal loading of the recording substrate occurs. Fluctuations of the temperature in the fixing gap lead to a deterioration of the fixing quality.

As a function of the material property of the recording substrate used, the recording substrate has, in the case of paper, a temperature in the range from 90° to 120° on leaving the thermal fixing device W. This heat stored in the recording substrate must be dissipated in the cooling device K to such an extent that the paper has a temperature below 60° after stacking in the stacking device S, so that no adhesion of the printed images lying on one another can occur. This means, in the case of the given data, that the paper web must be cooled by 60° K. in about 0.5 second. This corresponds to a power dissipation of about 4000 W in 0.5 second.

Figure 2:
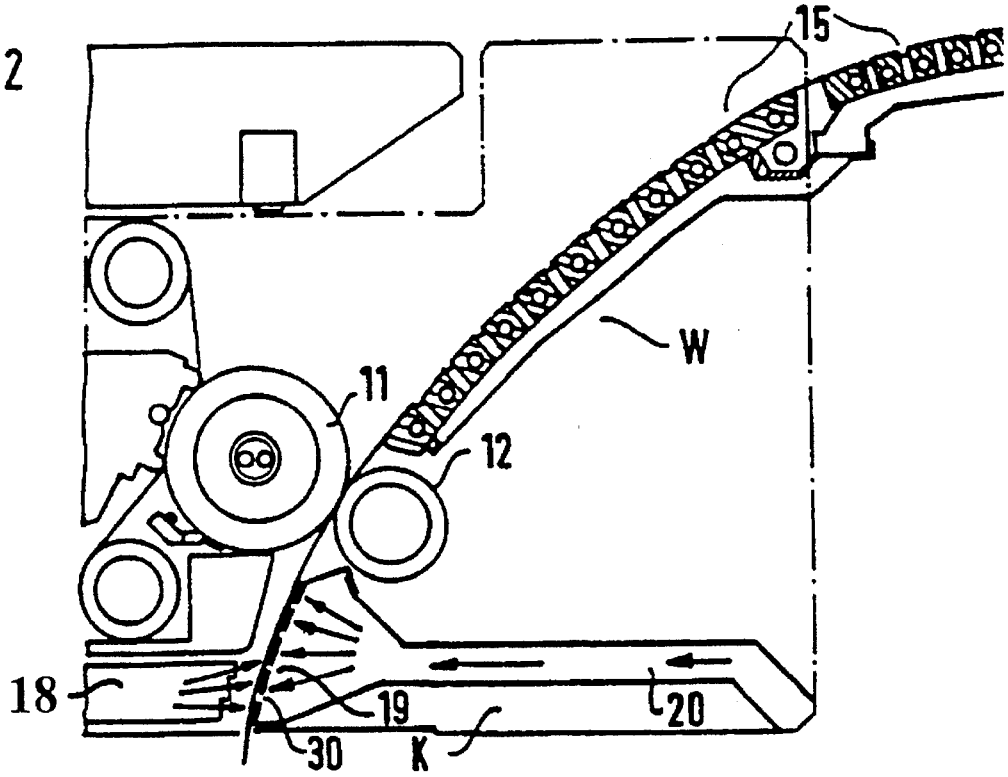
FIG. 2 shows a schematic sectional representation of an embodiment of a cooling device for the heated recording substrate having a cooling surface, penetrated by air exit nozzles, for producing an air cushion between cooling surface and recording substrate.

In order to be able to provide this high thermal dissipation, the cooling device K is provided, which can be designed corresponding to the exemplary embodiments of FIG. 2.

In the case of the exemplary embodiment of FIG. 2, also shown in FIG. 1, the cooling device K contains a cooling surface 19 made of plastic or metal, having a multiplicity of air exit openings 30 arranged on the cooling surface. The cooling surface 19 extends in this case over the entire width of the recording substrate 17. It has a length which is dependent upon the necessary cooling power. The cooling surface 19 is connected to an air supply channel 20 and a blower 31, via which air is fed to the air supply channel 20. The cooling air emerges via the air exit openings 30 and lifts the recording substrate 17 lying on the cooling surface 19 by 0.1 to 0.5 mm relative to the cooling surface, with the result that the recording substrate 17 glides on the air cushion thus formed. The air moves at a high velocity in the narrow gap between recording substrate 17 and cooling surface 19. By this means, the hot paper web can be optimally cooled. For supplying the air exit openings 30 with cooling air, air is supplied in large volumes via blower 31 and supply channel 20 to the air exit openings 30 via a distributor space 32, at low noise and at relatively low flow velocity.

In order to be able to guide the recording substrate 17 along the cooling surface 19 in a secure manner, the cooling surface has a radius of curvature which corresponds approximately to the radius of curvature of the preheating saddle 15. It is arranged in such a way that the recording substrate 17 is guided steplessly in a prescribed radius of curvature through the thermal fixing station, including preheating saddle and cooling device.

For the additional dissipation of heat from the recording substrate 17, in the paper run region accommodating the cooling surface 19, an additional cooling device 18 is arranged on a side, of the recording substrate 17, facing away from the cooling device K. It comprises a hollow profile having air exit openings 33, which are arranged in stages along the paper run region. The hollow profile 18 is connected to a blower 34, which supplies the hollow profile 18 with cooling air. The blower 34 can also be a component of the blower 31. The cooling air supplied to the hollow profile 18 emerges at the air exit openings 33, specifically in such a manner that it sweeps the recording substrate on its toner-laden side in the direction opposite to the running direction of the recording substrate 17. If the air flow is directed in opposition to the running direction of the recording substrate, the surface boundary layer of air on the recording substrate 17 is penetrated by cooling air, which reinforces the cooling effect.

As already explained at the outset, the electrophotographic printing device shown contains a stacking device S. It serves for the purpose of stacking the recording substrate 17 via conveyor rollers 39 onto a deposit surface, not shown here, from where it can be removed in a jobwise manner. The stacking device S in this arrangement can have, in its inlet region corresponding to the representation of FIG. 1, air supply profiles 40, with air exit openings 41, arranged on both sides of the recording substrate 17. The air supply profiles 40 in this case extend over the entire width of the recording substrate, the air exit openings 41 being directed in such a way that they produce an air stream sweeping over both sides of the recording substrate, said air stream being directed in the direction opposite to the running direction of the recording substrate. The air supply profiles 40 could thus be connected to blowers or other air supply devices. Instead of continuous air supply profiles with air exit openings, it is also possible to arrange individual separate blower elements, distributed across the width of the recording substrate, or a blower element with a corresponding distributor device for the air stream.

In the exemplary embodiments shown, there is arranged in each case in the paper run region a cooling saddle with associated cooling surface. Instead of only one cooling saddle, a plurality of cooling saddles can also be arranged one after another, which are in each case flowed through by the cooling medium. They then form a common combined cooling surface.

It should be understood that various changes and modifications to the presently preferred embodiments will be apparent to those skilled in the art. For example, the recording substrate can be any sheet recording medium other than a paper sheet, such as a transparent plastic sheet. Such changes and modifications can be made without departing from the spirit and scope of the present invention and without diminishing its intended advantages. Therefore, it is intended that such changes and modifications be covered by the presently preferred embodiments.

What is claimed is:

1. An apparatus comprising:

a device for producing a toner image on a recording substrate;

a thermofixing device for fixing the toner image on the recording substrate with heat;

a first cooling device for cooling the heated recording substrate, the cooling device being arranged in a paper run region downstream of the thermofixing device in a direction of transport of the recording substrate and having at least one cooling surface over which the recording substrate is guided, said cooling surface having a multiplicity of air exit openings and an air supply device coupled to the air exit openings for producing an air stream in such a way that an air cushion is formed between the recording substrate and the cooling surface; and at least one second cooling device arranged in the paper run region on a side of the recording substrate opposite from the first cooling device, for producing at least one second air stream sweeping over the recording substrate.

2. The apparatus as claimed in claim 1, further comprising a heated preheating saddle positioned upstream of the thermofixing device relative to the running direction of the recording substrate.

3. An apparatus comprising:

a device for producing a toner image on a recording substrate;

a thermofixing device for fixing the toner image on the recording substrate with heat;

a cooling device for cooling the heated recording substrate, the cooling device being arranged in a paper run region downstream of the thermofixing device in a direction of transport of the recording substrate and having at least one cooling surface over which the recording substrate is guided, said cooling surface having a multiplicity of air exit openings and an air supply device coupled to the air exit openings for producing an air stream in such a way that an air cushion is formed between the recording substrate and the cooling surface;

a stacking device for the recording substrate arranged downstream of the cooling device relative to the direction of transport of the recording substrate; and an air stream device at a recording substrate entry region of the stacking device, for producing an air stream sweeping over at least one side of the recording substrate.

4. The apparatus as claimed in claim 3 wherein at least one air stream sweeps over the recording substrate in a direction generally opposite to the direction of transport.

5. An apparatus comprising:

a device for producing a toner image on a recording substrate;

a thermofixing device for fixing the toner image on the recording substrate with heat; and a cooling device for cooling the heated recording substrate, the cooling device being arranged in a paper run region downstream of the thermofixing device in a direction of transport of the recording substrate and having at least one cooling surface over which the recording substrate is guided, said cooling surface having a multiplicity of air exit openings and an air supply device coupled to the air exit openings for producing an air stream in such a way that an air cushion is formed between the recording substrate and the cooling surface;

wherein at least one air stream sweeps over the recording substrate in a direction generally opposite to the direction of transport.

6. An apparatus comprising:

a device for producing a toner image on a recording substrate;

a thermofixing device for fixing the toner image on the recording substrate with heat; and a cooling device for cooling the heated recording substrate, the cooling device being arranged in paper run region downstream of the thermofixing device in a direction of transport of the recording substrate and having at least one cooling surface over which the recording substrate is guided, said cooling surface having a multiplicity of air exit openings and an air supply device coupled to the air exit openings for producing an air stream in such a Way that an air cushion is formed between the recording substrate and the cooling surface;

wherein the cooling surface is shaped to follow a consistent contour of a passage direction of the recording substrate through the thermofixing device.

7. An apparatus comprising:

a device for producing a toner image on a recording substrate;

a thermofixing device for fixing the toner image on the recording substrate with heat;

a cooling device for cooling the heated recording substrate, the cooling device being arranged in a paper run region downstream of the thermofixing device in a direction of transport of the recording substrate and having at least one cooling surface over which the recording substrate is guided, said cooling surface having a multiplicity of air exit openings and an air supply device coupled to the air exit openings for producing an air stream in such a way that an air cushion is formed between the recording substrate and the cooling surface; and a heated preheating saddle positioned upstream of the thermofixing device relative to the running direction of the recording substrate;

wherein the cooling surface has a radius of curvature approximately corresponding to a radius of the preheating saddle.

8. An apparatus comprising:

a sheet transporter for transporting a sheet in a transport direction;

a thermofixing device applying a selected toner image on a sheet, the thermofixing device heating the sheet;

at least one cooling device cooling the sheet in a region downstream of the thermofixing device relative to the sheet transport direction, the cooling device including:

at least one cooling surface over which the sheet is guided;

a plurality of air exit openings in the cooling surface; and;

an air supply device providing air to the air exit openings producing an air stream between the sheet and cooling device such that an air cushion is formed between the sheet and the cooling surface;

wherein the cooling surface is contoured contiguously with a passage path of the sheet exiting the thermofixing device.

9. The apparatus as claimed in claim 8, further comprising a heated preheating saddle upstream of the thermofixing device relative to the transport direction, the preheating saddle heating having a heating surface across which the sheet is transported, heating the sheet.

10. The apparatus as claimed in claim 8, further comprising:

at least one second cooling device directing an airstream against a side of the sheet opposite the air stream of the first cooling device.

11. The apparatus as claimed in claim 8 further comprising:

a stacking device downstream of the cooling device relative to the transport direction;

an air stream device at a recording substrate entry region of the stacking device for producing an air stream sweeping over at least one side of the recording substrate.

12. An apparatus comprising:

a sheet transporter for transporting a sheet in a transport direction;

a thermofixing device applying a selected toner image on a sheet, the thermofixing device heating the sheet;

a heated preheating saddle upstream of the thermofixing device relative to the transport direction, the preheating saddle heating having a heating surface across which the sheet is transported, heating the sheet; and at least one cooling device cooling the sheet in a region downstream of the thermofixing device relative to the sheet transport direction, the cooling device including:

at least one cooling surface over which the sheet is guided; and a plurality of exit openings in the cooling surface providing an air stream between the sheet and cooling device; and wherein the cooling surface has a radius of curvature approximately equal to a radius of curvature of the heating surface of the preheating saddle.

13. An apparatus comprising:

a sheet transporter for transporting a sheet in transport direction;

a thermofixing device applying a selected toner image a sheet, the thermofixing device heating the sheet;

at least one cooling device cooling the sheet in a region downstream of the thermofixing device relative to the sheet transport direction;

a stacking device downstream of the cooling device relative to the transport direction;

an air stream device at a recording substrate entry region of the stacking device for producing a first air stream sweeping over a first side of the recording substrate;

wherein a second air stream is directed in such a manner that it sweeps over a second side of the recording substrate in a direction generally opposite to the transport direction.

* * * * *